US005547260A

United States Patent [19]

Kawai et al.

[11] Patent Number: 5,547,260

[45] Date of Patent: Aug. 20, 1996

[54] AUXILIARY CUTTER UNITS OF A SHIELD MACHINE

[75] Inventors: Kazunari Kawai; Norio Mitani, both of Hirakata, Japan

[73] Assignee: Kabushiki Kaisha Komatsu Seisakusho, Tokyo, Japan

[21] Appl. No.: 186,656

[22] Filed: Jan. 25, 1994

[30] Foreign Application Priority Data

Feb. 19, 1993 [JP] Japan ..... 5-011009 U

[51] Int. Cl.[6] ..... E21D 9/08

[52] U.S. Cl. ..... 299/33; 299/55

[58] Field of Search ..... 405/138, 141, 405/142, 143, 144, 145; 299/31, 33, 55, 56, 90

[56] References Cited

U.S. PATENT DOCUMENTS

| | | | |
|---|---|---|---|
| 3,556,599 | 1/1971 | Fikse | 405/144 X |
| 3,917,351 | 11/1975 | Pirrie et al. | 299/90 |
| 3,966,256 | 6/1976 | Fikse | 299/33 |
| 4,311,344 | 1/1982 | Akesaka | 299/33 |
| 4,482,270 | 11/1984 | Unger et al. | 405/141 X |
| 4,630,869 | 12/1986 | Akesaka et al. | 299/56 X |
| 5,104,261 | 4/1992 | Anderson et al. | 405/141 X |

*Primary Examiner*—David J. Bagnell

*Attorney, Agent, or Firm*—Flynn, Thiel, Boutell & Tanis, P.C.

[57] ABSTRACT

Preliminary cutter units of a shield machine provided with preliminary cutters capable of continuously excavating soil in a working place even if main cutters are worn away. In a shield machine comprising a cutter head which is disposed at the front end of a shield body and is rotated by cutter head motors, and a plurality of main cutters which are attached to the front surface of a face plate of the cutter head and are disposed in the radial direction of the cutter head, the shield machine further comprises preliminary cutter units each of which is attached to a cutter attachment member provided inside the face plate and swingably supported by quadric links and includes a reaction receiver pad attached to the lower surface of the face plate, a lever which is brought into contact with the reaction receiver pad for receiving external force which is applied to the preliminary cutter, an auxiliary link for connecting the lever and the rear end of the cutter attachment member and a hydraulic jack unit which is mounted on the lever for projecting each of the preliminary cutter from the front portion of the face plate or retracting the projected preliminary cutter from the front portion of the face plate.

20 Claims, 8 Drawing Sheets

AUXILIARY CUTTER UNITS OF A SHIELD MACHINE

BACKGROUND OF THE INVENTION

1. Field of the Invention

The present invention relates to auxiliary cutter units of a shield machine.

2. Prior Art

A prior art shield excavator for excavating earth, stone or other materials (hereinafter referred to as soil) for forming a tunnel is provided with a cutter head which is disposed at the front end of a shield body and is rotated by a cutter head motor and to which a plurality of cutters are attached.

The cutters are normally detachably attached to a front surface of a face plate of the cutter head by fixed members such as bolts and are replaceable with new ones when they are broken or worn away during excavation.

When the cutters are broken or worn away during the excavation, an operator enters between the cutter head and a working place and replaces the broken cutters with new ones. However, there are drawbacks that it takes much time for replacement, which leads to the extension of a term of construction work, and it involves a danger that the working place collapses and is deluged since the working place is under inferior working condition.

SUMMARY OF THE INVENTION

It is an object of the present invention to solve the problems set forth above and to provide preliminary or auxiliary cutter units of a shield machine each having a plurality of preliminary or auxiliary cutters capable of performing excavation in a working place when the main cutters are broken or worn away.

To achieve the above object, in the shield machine of the present invention comprising a cutter head which is disposed at the front end of a shield body and is rotated by a cutter head motor, a plurality of main cutters which are attached to the front surface of a face plate of the cutter head and are disposed in a radial direction thereof, the shield machine further comprises cutter attachment members provided inside the face plate and swingably supported by quadric links, preliminary or auxiliary cutter units each of which is attached to a tip end of the cutter attachment member and includes a plurality of preliminary or auxiliary cutters, a reaction receiver pad attached to the lower surface of the face plate, a lever which is disposed at the rear of the cutter attachment member and is brought into contact with the reaction receiver pad for receiving external excavating force (hereinafter referred to as external force) applied to the preliminary or auxiliary cutters, an auxiliary link for connecting the lever and a rear end of the cutter attachment member and a hydraulic jack unit which is mounted on the lever for projecting the preliminary or auxiliary cutters from the front surface of the face plate or retracting projected preliminary or auxiliary cutters from the front surface of the face plate.

Since the external force applied to the preliminary cutters is received by the reaction receiver and it does not influence directly upon the hydraulic jack units when the soil is excavated by the preliminary cutters, the hydraulic jack units can be made small.

PREFERRED EMBODIMENTS OF THE INVENTION

Figure 1:
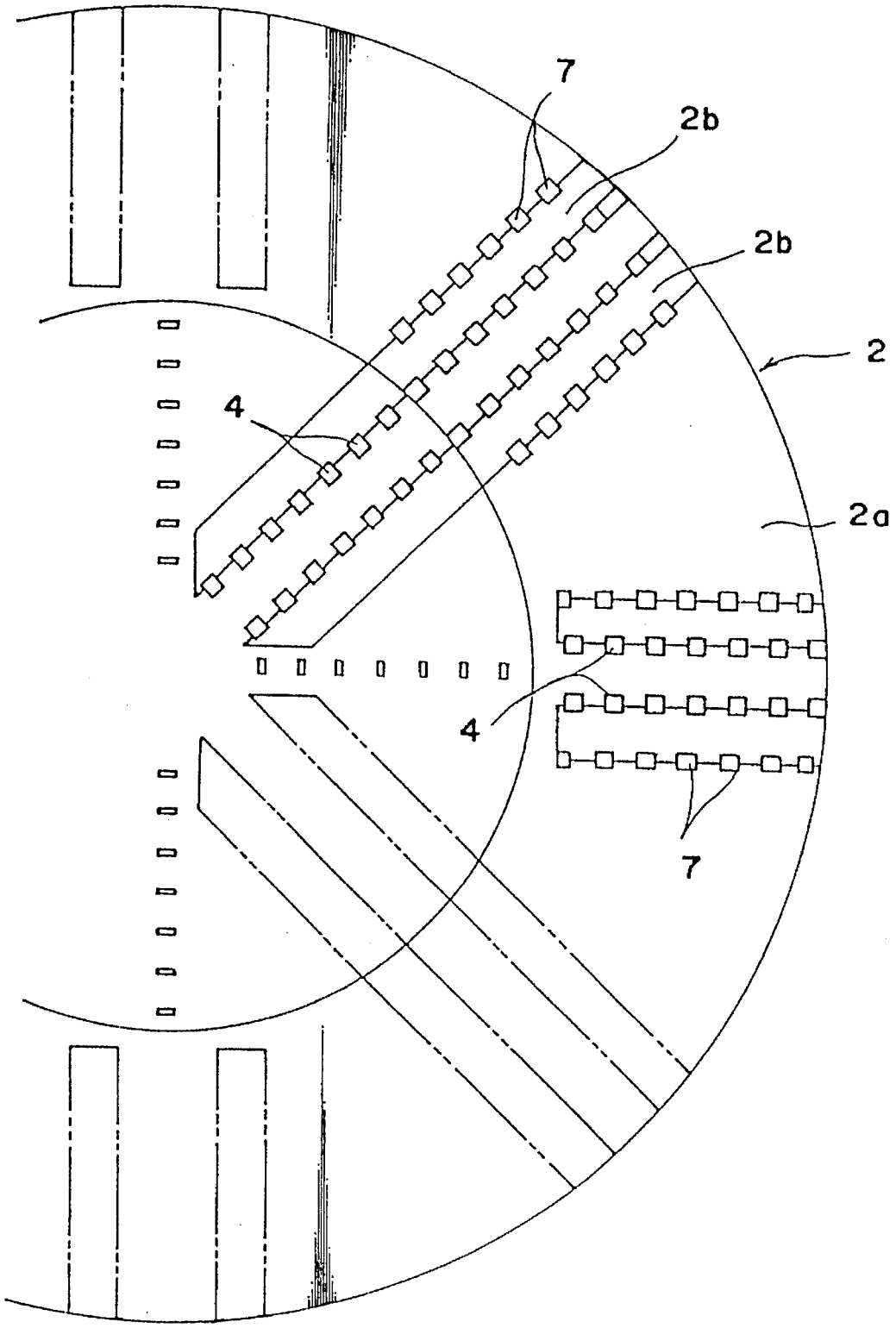
FIG. 1 is a front view of a shield machine provided with preliminary cutter units according to a first embodiment of the invention.
Figure 2:
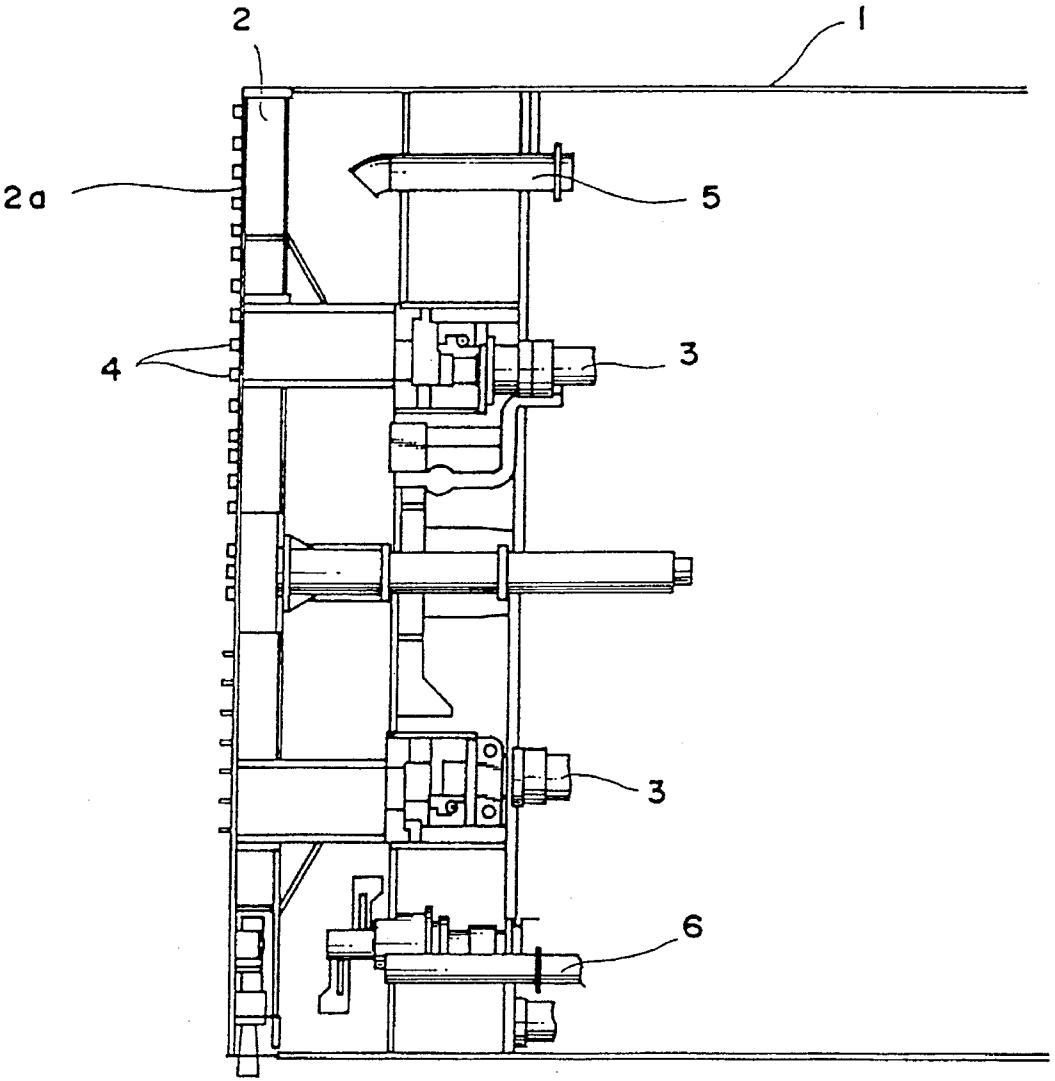
FIG. 2 is a cross-sectional view of the shield machine of FIG. 1.
Figure 3:
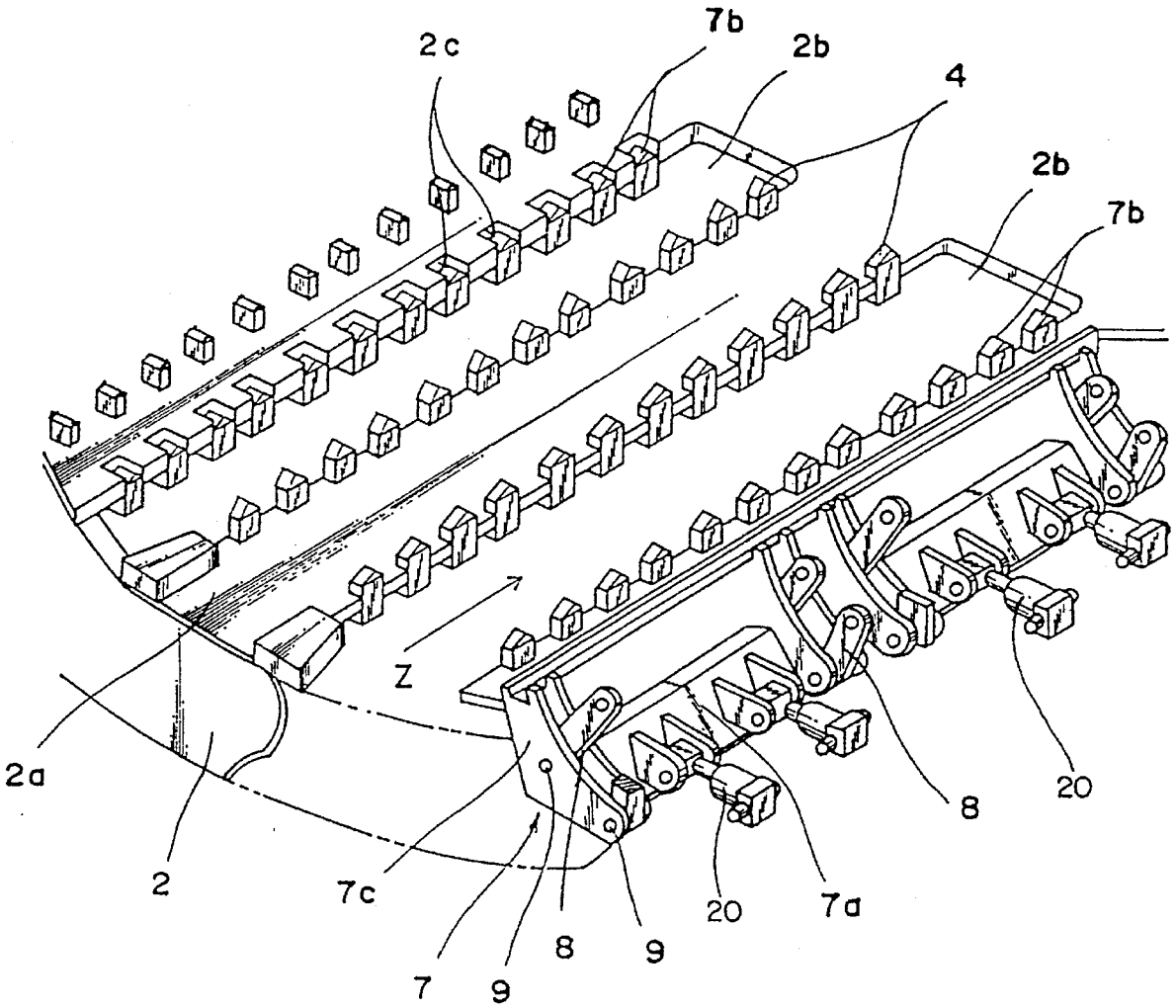
FIG. 3 is a perspective view showing the state where a preliminary cutter unit is mounted on the shield machine.
Figure 4:
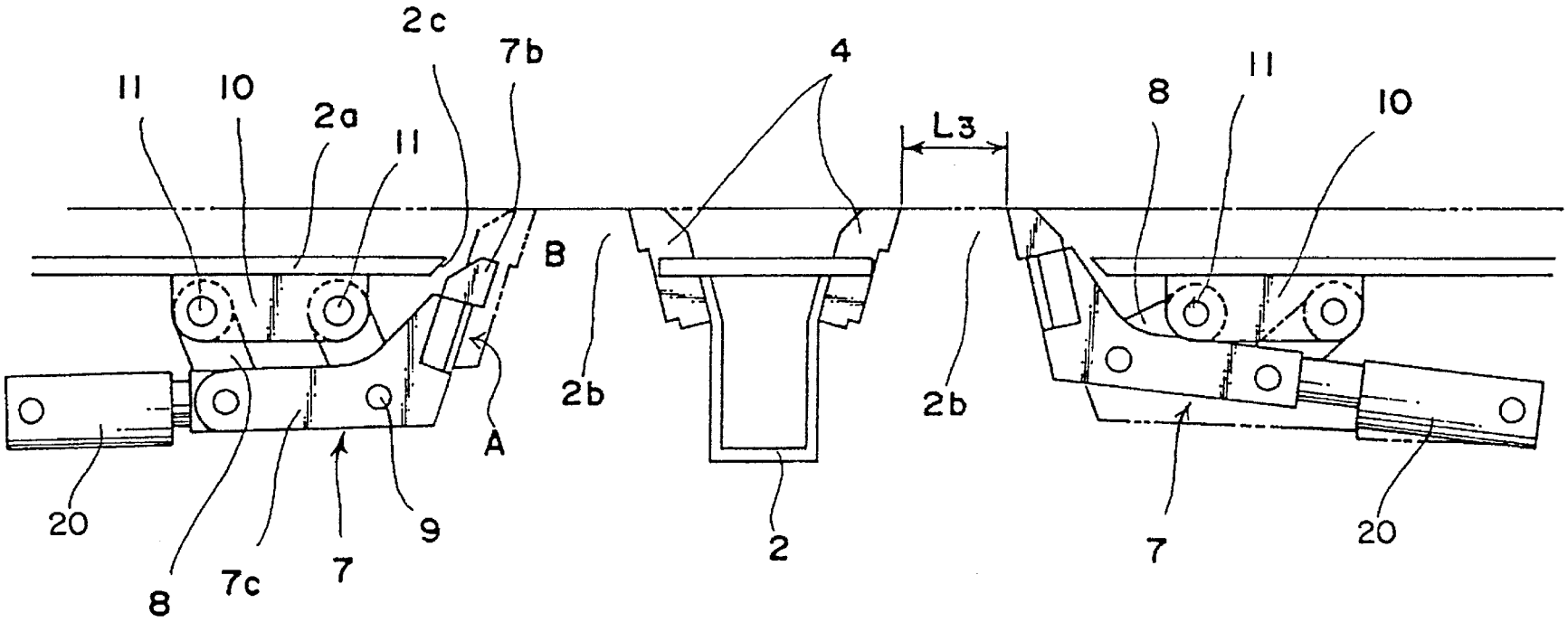
FIG. 4 is a view of the preliminary cutter unit of FIG. 3 as viewed from the direction of Z in FIG. 3.

First Embodiment (FIGS. 1 to 5):

Preliminary or auxiliary cutter units according to the first embodiment of the invention will be described with reference to FIGS. 1 to 5.

A cutter head 2 provided at the front portion of a shield body 1 can be rotated by cutter head motors 3.

A plurality of main cutters 4 are attached radially to a face plate 2*a* provided at the front surface of the cutter head 2 wherein soil in a working place is excavated by these main cutters 4 during the rotation of the cutter head 2. The soil thus excavated by the main cutters 4 is taken in a chamber by soil taking-in ports 2*b* and is made slurry by mud water introduced by a mud feed tube 5. The slurry earth, i.e. mud is introduced into the shield body 1 by a mud discharge tube 6 and is discharged rearward.

Preliminary or auxiliary cutter units 7 are positioned to confront the main cutters 4 at the outer peripheral portion of the face plate 2*a* where the main cutters 4 are heavily worn away with intervening the soil taking-in ports 2*b* therebetween. Each of the preliminary cutter units 7 includes cutter attachment members 7*a*, which are, for example, halved in a radial direction of the face plate 2*a* inside the face plate 2*a* and preliminary or auxiliary cutters 7*b* which are attached to the tip ends of the cutter attachment members 7*a* and disposed substantially in the same arrangement of the main cutters 4.

There are provided end plates 7*c* at both end sides of the cutter attachment members 7*a* wherein the end plates 7*c* are substantially L-shaped and paired. Links 8 are pivotally connected to the end plates 7*c* in the manner that respective one ends of the links 8 are pivotally connected by pins 9 to the bent portions and rear ends of the end plates 7*c*. The other ends of the links 8 are pivotally connected by a pin 11 to a bracket 10 protruding from the rear surface of the face plate 2*a*. A plurality of hydraulic jack units 20 are provided at the rear portion of the cutter attachment members 7*a*. When the cutter attachment member 7*a* is pushed by the hydraulic jack unit 20 from a position A to a position B in FIG. 4, the tip end of the preliminary cutter 7*b* attached to the cutter attachment member 7*a* is projected forward from a comb-shaped notched portion 2*c* of the face plate 2*a* defined at the opening edge of the soil taking-in port 2*b*.

The operation of the preliminary cutter units according to the first embodiment will be described hereinafter.

The preliminary cutters 7*b* of the preliminary cutter units 7 are accommodated inside the face plate 2*a* when the main cutters 4 are not broken or worn away. In this state, the cutter head motor 3 drives to rotate the cutter head 2 so that the main cutters 4 excavate the soil in the working place while the shield body i advances. When the main cutters 4 are broken or worn away during the excavation for a long distance, and hence excavating performance is deteriorated, the hydraulic jack unit 20 is extended to thereby push the preliminary cutter 7*b* so that the preliminary cutter 7*b*, which was accommodated inside the face plate 2*a* until now, is projected from the front surface, namely, from the notched portion 2*c* of the face plate 2*a*. As a result, since the soil in the working place can be continuously excavated while the shield body 1 advances, the main cutters 4 are not necessary to be replaced with new ones, which shortens a term of construction work.

Figure 5:
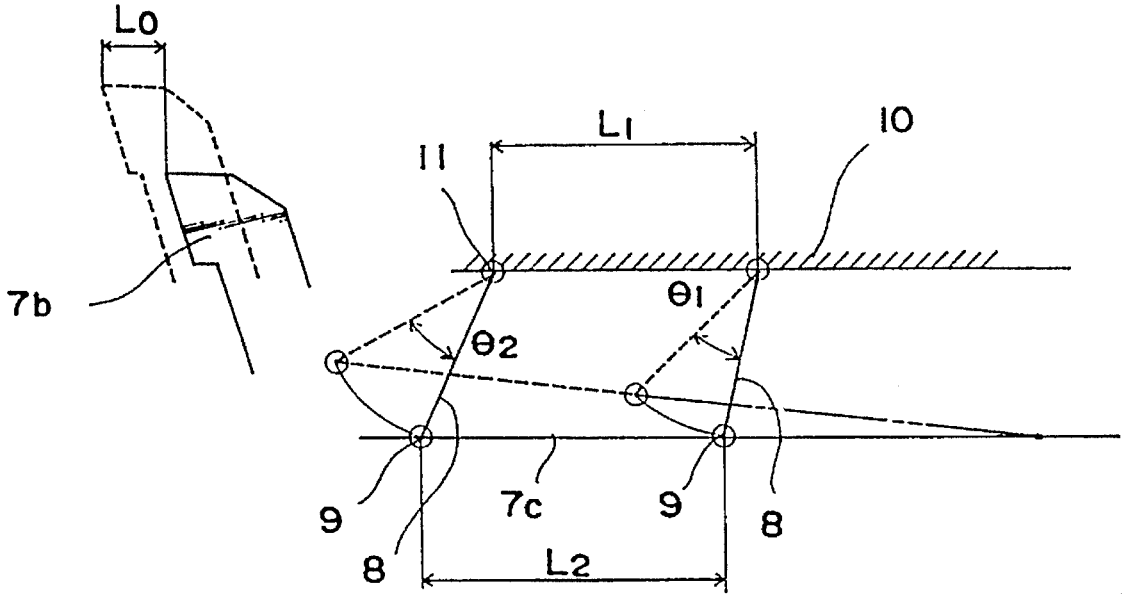
FIG. 5 is a view explaining a link mechanism for supporting a cutter attachment member.

If an interval $L_1$ between the front and rear links 8 attached at the other ends thereof to the bracket 10 is previously set to be less than an interval $L_2$ between the these links 8, which swingably support the cutter attachment member 7*a* having the preliminary cutter 7*b* and are attached at one ends thereof to the end plate 7*c* of the cutter attachment member 7*a*, an angle $\theta_2$ formed by the front link 8, namely, the angle $\theta_2$ between the pin 9 before the preliminary cutter 7*b* is projected as shown in a solid line in FIG. 5, the pin 11 and the pin 9 after the preliminary cutter 7*b* is projected forward as shown in a dotted line in FIG. 5, is greater than an angle $\theta_1$ formed by the rear link 8. As a result, when the preliminary cutter unit 7 is pushed forward by the hydraulic jack unit 20 out of the face plate 2*a*, the amount of movement $L_0$ of the preliminary cutter 7*b* can be smaller than the amount of movement if the preliminary cutter was pushed forward by a normal parallel link. Accordingly, a width $L_3$ of the soil taking-in port 2*b* is less varied so that the excavating condition is restrained from varying even when the preliminary cutters are used.

Figure 6:
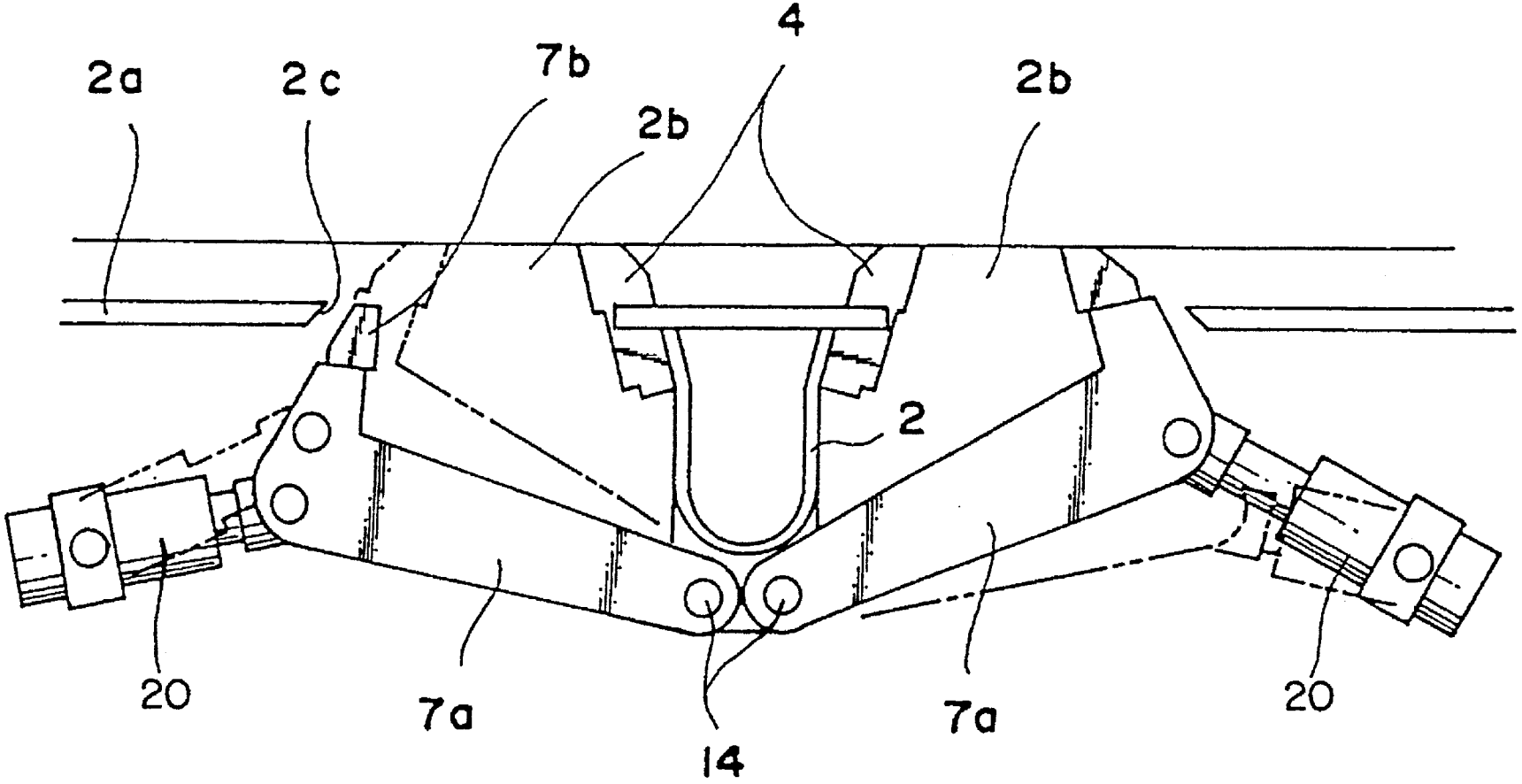
FIG. 6 is a link mechanism of preliminary cutter units according to a second embodiment of the invention.

Second Embodiment (FIG. 6):

Although the cutter attachment member 7*a* of the preliminary cutter unit 7 is swingably supported by the parallel links 8 according to the first embodiment, it can be structured as illustrated in FIG. 6. That is, the cutter attachment members 7*a* are respectively substantially L-shaped wherein the rear ends thereof are pivotally connected by pins 14 at the portion adjacent to the main cutter 4 while bent portions thereof are connected to the hydraulic jack units 20 wherein the cutter attachment members 7*a* are turned about the pins 14 so as to project the preliminary cutters from the notched portions 2*c* of the face plate or retract the projected preliminary cutters 7*b* from the notched portions 2*c* of the face plate.

Figure 7:
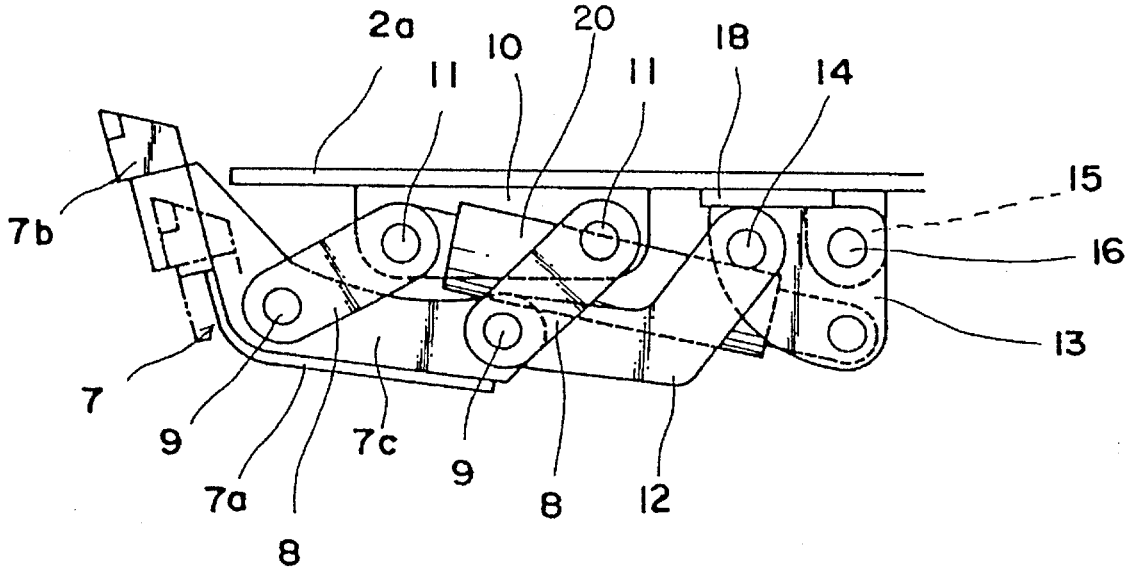
FIG. 7 is a side view showing the state where a preliminary cutter unit is mounted on the shield machine according to a third embodiment of the invention.
Figure 8:
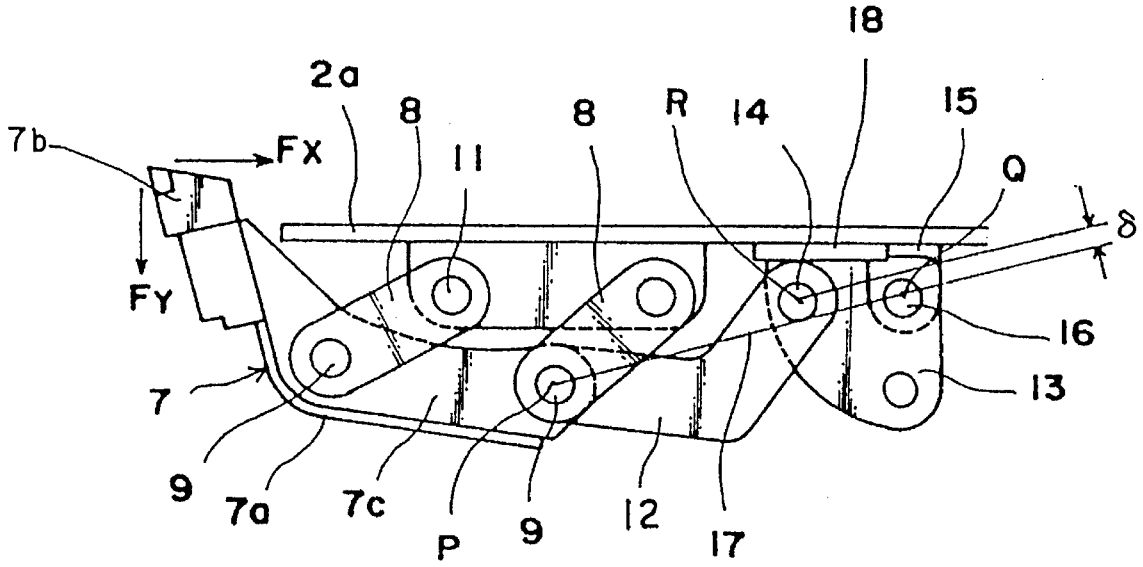
FIG. 8 is a view explaining the operation of the preliminary cutter unit of FIG. 7.
Figure 9:
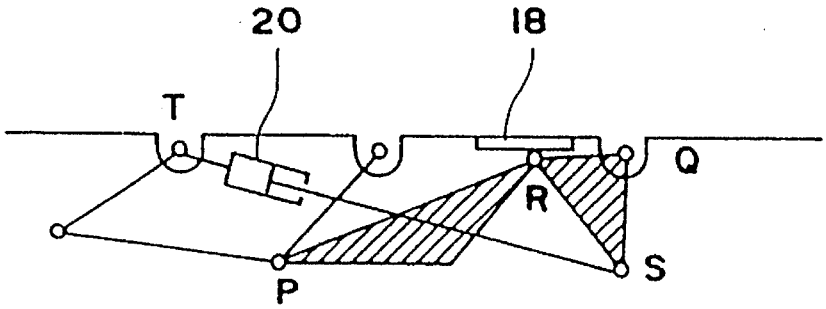
FIG. 9 is a view further explaining the operation of the preliminary cutter unit of FIG. 7.

Third Embodiment (FIGS. 7 to 9):

An arrangement of the preliminary cutter units 7 according to a third embodiment of the invention as illustrated in FIGS. 7 to 9 is substantially the same as those of the first embodiment. Components which are the same as those of the first and second embodiment are denoted at the same numerals.

In the third embodiment, there is provided an inverse L-shaped auxiliary link 12 which is pivotally connected at one end thereof to the rear end of the cutter attachment member 7*a* by the pin 9. The pin 9 also pivotally connects the rear link 8 to the bracket 10. There is also provided a fan-shaped lever 13 which is turnably pivotally connected at a rivet portion thereof to a bracket 15 protruding from the rear surface of the face plate 2*a* by a pin 16. The other end of the auxiliary link 12 is pivotally connected to one corner of the lever 13 by a pin 14. There is also provided a reaction receiver pad 18 which is fixed to the rear surface of the face plate 2*a*. The pin 14 for pivotally connecting the other end of the auxiliary link 12 to the one corner of the lever 13 is off set toward the face plate 2*a* in FIG. 4 by a distance $\delta$ with respect to a neutral line 17 connecting between the pin 16 and the pin 9 for pivotally connecting one end of the auxiliary link 12. When the soil is excavated by the preliminary cutter 7*b*, one side of the lever 13 to which the other end of the auxiliary link 12 is pivotally connected is brought into contact with the reaction receiver pad 18.

The hydraulic jack unit 20 is attached between the other corner of the lever 13 and the pin 11 for pivotally connecting the link 8 and the bracket 10, thereby projecting the preliminary cutters 7*b* from the notched portion 2*c* of the face plate or retracting the projected preliminary cutters from the notched portion 2*c* of the face plate.

The operation of the preliminary cutter units 7 according to the third embodiment will be described hereinafter.

The preliminary cutter 7*b* of the preliminary cutter unit 7 is accommodated inside the face plate 2*a* in the manner that the tip end of the preliminary cutter 7*b* is positioned inside the face plate 2*a* when the main cutters 4 are not broken or worn away. In this state, the cutter head motor 3 is driven to rotate the cutter head 2 so that the main cutters 4 excavate the soil in the working place while the shield body 1 advances. When the main cutters 4 are broken or worn away during the excavation for a long distance, and hence excavating performance is deteriorated, the hydraulic jack unit 20 is extended to thereby push the preliminary cutter 7*b* so that the preliminary cutter 7*b* is projected from the notched portion 2*c* of the face plate 2*a* as shown in FIG. 7 which was accommodated inside the face plate 2*a* until now. As a result, the soil in the working place can be continuously excavated while the shield body I advances, and the one side of the lever 13 is brought into contact with the reaction receiver pad 18 as shown in FIG. 8 during the excavation for receiving the external force applied to the preliminary cutter 7*b*, whereby the external force does not influence upon the hydraulic jack unit 20.

That is, supposing that external forces applied to the preliminary cutters 7*b* during the excavation are $F_x$ and $F_y$ in FIG. 8, the rear link 8 is liable to rotate counterclockwise about the pin 11 due to the external forces $F_x$ and $F_y$. However, the one side of the lever 13 is brought into contact with the reaction receiver pad 18 and establishes the following expression as shown in FIG. 9.

$$\overline{PR}+\overline{QR}>\overline{PQ}$$

Since the reaction receiver pad 18 prevents the lever 13 from moving upward at the pin 14 to reduce an angle PRQ formed by the pins 9 (P), 14 (R) and 16 (Q), the link 8 and the auxiliary link 12 supports the external forces $F_x$ and $F_y$, the external forces $F_x$ and $F_y$ do not apply to the hydraulic jack unit 20. As a result, the hydraulic jack unit 20 is made small to the extent that the preliminary cutter 7*b* is projected from the notched portion 2*c* of the face plate 2*a* or retracted from the notched portion 2*c* of the face plate 2*a*.

As a result, since the soil in the working place can be continuously excavated by the preliminary cutters when the main cutters are broken or worn away while the shield body advances for a long distance, the main cutters are not necessary to be replaced with new ones, which contributes to the shortening of a term of construction work and safety of the operator. Furthermore, since the preliminary cutter units can be mounted on the shield machine without changing the structure of the shield machine, the shortening of a term of construction work and safety of the operator can be achieved with ease and low cost.

Still furthermore, since the external force applied to the preliminary cutters can be received by the reaction pad provided at the rear surface of the face plate by way of the auxiliary link and the lever, the external forces do not directly apply to the hydraulic jack unit. As a result, the hydraulic jack unit or a hydraulic system is not damaged by excessive external forces, which dispenses with an overload protection circuit which had been provided in the prior art hydraulic system and a leakage compensation circuit within the hydraulic jack unit, and hence the hydraulic system is simplified and reliability of the hydraulic system involved thereby is improved. Further, since the hydraulic jack units are made small to the extent that the preliminary cutters are projected from the notched portion of the face plate or retracted from the notched portion of the face plate.

What is claimed is:

1. An excavating assembly including:

a main body having a front section;

a cutter head rotatably attached to said main body front section, said cutter head having a face plate and a plurality of teeth attached to said face plate that extends forward therefrom, said cutter head face plate being formed with teeth pockets that extend through said face plate;

at least one auxiliary cutter unit attached to said cutter head rearward of said face plate, said auxiliary cutter unit including:

an auxiliary cutter unit body;

a plurality of forwardly extending cutter teeth attached to said auxiliary cutter unit body, said auxiliary cutter teeth being positioned to be selectively seated in said cutter head face plate teeth pockets; and two linkage members, each said linkage member being pivotally connected at one end thereof to said cutter head and at opposed end thereof to said auxiliary cutter unit body to move said auxiliary cutter unit body from a retracted position wherein said teeth auxiliary cutter unit teeth are disposed in said cutter head face plate teeth pockets and an extended position wherein said auxiliary cutter unit teeth project forward of said cutter head face plate, said linkage members being connected to said cutter head at pivot point spaced apart a first distance and are connected to said auxiliary cutter unit body at pivot points spaced apart a second distance greater than said first distance; and an actuator connected to said at least one auxiliary cutter unit body for selectively moving said auxiliary cutter unit from said retracted position to said extended position.

2. The excavating assembly of claim 1, wherein said cutter head face plate is formed with at least one soil evacuation port and said teeth pockets are formed in said face plate so as to be contiguous with said soil evacuation port.

3. The excavating assembly of claim 1, wherein said assembly includes a plurality of auxiliary cutter units.

4. The excavating assembly of claim 1, wherein:

said cutter head face plate is formed with a plurality of soil evacuation ports, said cutter head cutter teeth are arranged to extend from said cutter head front face plate along a first side of said soil evacuation ports and said teeth pockets are formed contiguously with said soil evacuation ports along a second side of said soil evacuation ports; and a plurality of auxiliary cutter units are attached to said cutter head, each said auxiliary cutter unit being attached to said cutter head so that when said auxiliary cutter unit is in said extended position, said auxiliary cutter unit cutter teeth extend through said teeth pockets associated with one said soil evacuation port.

5. An excavator assembly including:

a main body having a front section;

a cutter head rotatably attached to said main body front section, said cutter head having a face plate and a plurality of teeth attached to said face plate that extend forward therefrom, said cutter head face plate being formed with a plurality of teeth pockets that extend through said face plate;

at least one auxiliary cutter assembly attached to said cutter head rearward of said face plate, said auxiliary cutter assembly including:

an auxiliary cutter assembly body positioned to move between a first, retracted position and relative to said cutter head, and a second, extended position relative to said cutter head;

a plurality of cutter teeth attached to said auxiliary cutter assembly body so that when said auxiliary cutter assembly body is in said retracted position, said auxiliary cutter assembly cutter teeth are disposed in said cutter head face plate teeth pockets and when said auxiliary cutter assembly body is in said extended position, said auxiliary cutter assembly cutter teeth project forward of said cutter head face plate; and a linkage assembly for connecting said auxiliary cutter assembly body to said cutter head, said linkage assembly including: a pair of spaced apart linkage members pivotally connected at one end to said cutter head and at a second end distal to said first end to said auxiliary cutter assembly body; a lever having a pivot end pivotally connected to said cutter head at a location spaced from where said linkage members are connected to said cutter head and a distal end spaced from said pivot end; an auxiliary link connected between said auxiliary cutter assembly body and said lever distal end, said auxiliary link being connected to said auxiliary cutter assembly body and said lever and being shaped so that when said auxiliary cutter assembly is in said extended position and a rearward-directed force is imposed on said auxiliary cutter assembly cutter teeth, said auxiliary link urges said lever toward a portion of said cutter head; and an actuator connected to said at least one auxiliary cutter assembly for selectively moving said auxiliary cutter assembly body from said retracted position to said extended position.

6. The excavating assembly of claim 5, wherein said assembly includes a plurality of auxiliary cutter units.

7. The excavating assembly of claim 5, wherein said auxiliary link has a non-linear shape.

8. The excavating assembly of claim 5, wherein said actuator is connected between said cutter head and said lever.

9. The excavating assembly of claim 5, wherein said cutter head face plate is formed with at least one soil evacuation port and said teeth pockets are formed in said face plate so as to be contiguous with said soil evacuation port.

10. An excavating assembly including:

a body having a front section;

a cutter head rotatably attached to said body front section, said cutter head having a face plate and a plurality of teeth attached to said face plate that extend forward therefrom, said cutter head face plate being formed with teeth pockets that extend through said face plate;

at least one auxiliary cutter unit mounted on said cutter head, said auxiliary cutter unit including an auxiliary cutter unit body attached to said cutter head and a plurality of forwardly extending cutter teeth attached to said auxiliary cutter unit body, said auxiliary cutter unit body being attached to said cutter head so that when said auxiliary cutter unit is in a retracted position, said auxiliary cutter unit cutter teeth are disposed in said cutter head face plate teeth pockets and when said auxiliary cutter unit is in an extended position, said auxiliary cutter unit cutter teeth project forward of said cutter head face plate;

a linkage assembly connected between said cutter head and said auxiliary cutter unit body for moving said auxiliary cutter unit between said retracted and extended positions, said linkage assembly including at least one primary link pivotally connected between said cutter head and said auxiliary cutter unit body for controlling the movement of said auxiliary cutter unit between said retracted and extended positions and an auxiliary link connected to said auxiliary cutter unit and directed to a portion of said cutter head, said auxiliary link being positioned so that when said auxiliary cutter unit is in said extended position and a rearward force is imposed on said auxiliary cutter unit teeth, said auxiliary cutter unit is biased against said cutter head; and an actuator connected to said auxiliary cutter unit or said linkage assembly for selectively moving said auxiliary cutter unit from said retracted position to said extended position.

11. The excavating assembly of claim 10, wherein said actuator is connected to said linkage assembly.

12. The excavating assembly of claim 10, wherein said auxiliary link has a non-linear profile.

13. The excavating assembly of claim 10, wherein said linkage assembly is configured so that when a rearward-directed force is imposed on said auxiliary cutter unit cutter teeth, said auxiliary link is biased toward a rear portion of said cutter head face plate.

14. The excavating assembly of claim 13, wherein said linkage assembly includes a lever having a pivot end pivotally connected to said cutter head and a distal end spaced from said pivot end and said auxiliary link is pivotally connected to said lever distal end.

15. The excavating assembly of claim 14, wherein said actuator is connected between said cutter head and said linkage assembly pivot.

16. The excavating assembly of claim 14, wherein first and second primary links pivotally connect said auxiliary cutter unit body to said cutter head and said primary links are connected to said cutter head at pivot points spaced apart a first distance and are connected to said auxiliary cutter unit body at pivot points spaced apart a second distance greater than said first distance.

17. The excavating assembly of claim 13, wherein said auxiliary link has a non-linear profile.

18. The excavating assembly of claim 13, wherein said actuator is connected to said linkage assembly.

19. The excavating assembly of claim 10, wherein first and second primary links pivotally connect said auxiliary cutter unit body to said cutter head.

20. The excavating assembly of claim 19, wherein said first and second primary links are connected to said cutter head at pivot points spaced apart a first distance and are connected to said auxiliary cutter unit body at pivot points spaced apart a second distance greater than said first distance.

* * * * *

UNITED STATES PATENT AND TRADEMARK OFFICE

CERTIFICATE OF CORRECTION

PATENT NO. : 5 547 260

DATED : August 20, 1996

INVENTOR(S) : Kazunari KAWAI, et al.

It is certified that error appears in the above-indentified patent and that said Letters Patent is hereby corrected as shown below:

Column 5, line 46; delete "teeth".

Signed and Sealed this

Twenty-fifth Day of February, 1997

*Attest:*

Bruce Lehman

BRUCE LEHMAN

*Attesting Officer*

*Commissioner of Patents and Trademarks*